United States Patent [19]

Field

[11] Patent Number: 4,852,838

[45] Date of Patent: Aug. 1, 1989

[54] LOCKABLE BRACKET FOR ATTACHMENT TO WIRE GRID

[76] Inventor: Frank P. Field, 854 Napoli Dr., Pacific Palisades, Calif. 90272

[21] Appl. No.: 210,117

[22] Filed: Jun. 22, 1988

[51] Int. Cl.[4] ..... A47C 96/06

[52] U.S. Cl. ..... 248/222.1; 211/87; 248/222.2; 248/227; 248/301; 248/304

[58] Field of Search ..... 248/222.1, 223.3, 220.2, 248/222.2, 227, 301, 339, 304, 235, 243, 247, 250; 211/87, 59.1, 32, 106

[56] References Cited

U.S. PATENT DOCUMENTS

| | | | |
|---|---|---|---|
| 1,706,887 | 3/1929 | Knostman | 211/87 |
| 2,025,437 | 12/1935 | Brown | 211/87 X |
| 3,904,041 | 9/1975 | Medgebow | 211/72 |
| 4,340,144 | 7/1982 | Cousins | 211/87 |
| 4,431,154 | 2/1984 | Hamm | 248/215 |
| 4,504,992 | 3/1985 | Herron | 248/215 X |
| 4,579,308 | 4/1986 | Jensen | 211/87 X |
| 4,607,753 | 8/1986 | Radek | 248/222.2 X |
| 4,629,076 | 12/1986 | Amstutz et al. | 211/87 X |
| 4,678,151 | 7/1987 | Radek | 211/59.1 X |

*Primary Examiner*—Ramon O. Ramirez
*Attorney, Agent, or Firm*—Stetina and Brunda

[57] ABSTRACT

Disclosed is a bracket for lockably attaching various items to first and second, generally parallel support wires as may be incorporated within a section of rigid wire grid. The attachment bracket comprises a generally flat bracket body having a J-shaped curl at one longitudinal end thereof and an L-shaped flange at the opposite longitudinal end thereof. The bracket is specifically sized so that the J-shaped curl may be hooked over the first wire member while the L-shaped flange is slid under the second wire member. A slidable locking means is disposed on the body of the bracket so as to be slidably moveable between a "locked" position wherein it will hold the second wire member firmly within the angular convergence of the L-shaped flange and an "unlocked" position wherein the L-shaped flange of the bracket may be freely pulled away from the second wire member to allow subsequent detachment of the L-shaped curl from the first wire member. Specific items which may utilize the lockable attachment bracket include a garment hanging rod, a slotted garment hanging rack, and a merchandise display shelf.

10 Claims, 2 Drawing Sheets

LOCKABLE BRACKET FOR ATTACHMENT TO WIRE GRID

BACKGROUND OF THE INVENTION

This application relates broadly to the various applications wherein articles are attached to or suspended from wire grids. More particularly, the invention relates to a device which may be used for connecting articles such as garment display racks of the type used in retail clothing establishments to wire grid support structures.

Because the invention is particularly applicable to garment display racks, it will be described herein with particular reference thereto. It must be appreciated, however, that the invention has broader applications and may indeed find utility in connection with any application wherein an article or accessory is to be connected to two or more generally parallel support wires.

Garment racks of the type used in retail clothing establishments have heretofor included many adjustable racks for hanging garments. One particular type of garment rack comprises a series of hanger supporting rods which are detachably connected to a wire grid support structure. The support structure generally comprises a series of parallel, rigid, horizontal wire members which extend along one or more walls in the customer display area of the store. One or more hanger rods are attached to and extend perpendicularly from the wire grid by way of connector brackets. Each such connector bracket generally comprises a flat bar having a hook-shaped curl portion formed along the upper edge thereof. Such hook-shaped curl fits over and frictionally engages one of the horizontal wires of the grid while the lower end of the flat bar abuts an adjacent one of the horizontal wires. The result is that the bracket is held firmly on the wire grid and the hanger bar remains perpendicularly suspended therefrom. Such garment racks of the prior art provide a versatile and readily changeable means of displaying merchandise. Indeed, numerous garments may be hung from the hanger bars for customer perusal while the hanger rods remain slidably moveable along the horizontal wires. Also, if desired, each hanger bar/connector bracket may be disconnected and reconnected to higher or lower cross wires thereby altering the height of the garment hanger.

One drawback associated with such prior art garment hangers, however, is that the bottom end of the connector bracket is not locked in place. Thus, if a customer accidentally bumps or exerts upward pressure on the garment hanging rod, the upper end of the connector bracket may become detached from the wire grid, causing the hanger support rod and the displayed garments to fall to the floor.

Accordingly, there exists a need in the art for a modified connector bracket which may be easily connected to the wire grid and which will remain slidably movable therealong while at the same time being sufficiently locked into place so as to prevent inadvertent dislodgement of the connector bracket and resultant falling of the garments.

BRIEF DESCRIPTION OF THE INVENTION

The present invention overcomes the above-described problems of the prior art, and others, by providing a bracket which is lockably yet releasably connectable to two parallel wire members of a wire grid. The bracket of the present invention comprises a generally flat bracket body having first and second longitudinal ends. A J-shaped curl portion is formed at one of the longitudinal ends. The J-shaped curl defines therewithin a transversely extending groove or channel which renders the J-shaped curl positionable over one of the parallel wire members in a hook-like fashion. The opposite longitudinal end of the flat bracket body is provided with a rigid L-shaped flange comprising a perpendicular leg extending from the bracket body. The perpendicular leg of the L-shaped flange is positionable beneath a second one of the parallel wire members so as to receive the second parallel wire member above the upper surface of the perpendicular flange and against the inner surface of the flat bracket body.

A locking member is slidably disposed on the bracket body. Such locking member is operative to frictionally hold and capture the second parallel wire member above the perpendicular leg of the flange and against the rear surface of the bracket body. When, however, the slidable locking member is slidably lifted away from the L-shaped flange, the second wire member will be released from its position within the angular convergence of the L-shaped flange, thereby allowing the bracket body to be pulled away from the second parallel wire member. After the bracket body has been pulled away such that the L-shaped flange and locking member is disengaged from the second wire member, the opposite end of the bracket body may be easily lifted upwardly so as to disengage the J-hook from the first wire member, thereby fully detaching the bracket body from the supporting wire grid.

In accordance an even further aspect of the invention a clothing hanger rod may be connected to the front surface of the bracket body such that the clothing hanger rod will extend outwardly therefrom to permit the hanging of various garments therefrom.

In accordance with an even further aspect of the invention, two or more of the locking brackets may be employed jointly to provide individual anchoring points for multiple interconnected clothing hanger bars so as to form an interconnected network of hanger bars in the form of a display rack or the like. Such multiple connecting brackets may also be used to support a display shelf for holding other types of merchandise.

Even further in accordance with the invention, the locking member, which is slidably disposed upon the body of the connector bracket, may be fabricated in the form of a metal clip, such metal clip being loosely formed around the transverse edges of the bracket body so as to be longitudinally slidable therealong. The clip is further provided with a downwardly extending "keeper projection" which abuts the perpendicular leg of the L-shaped flange so as to trap the second wire member against the bracket body and the L-shaped flange. The distance between the keeper projection and the bracket body may be approximately equal to the width of the second wire member so as to result in a somewhat compressed fit of the wire member between the keeper projection and the bracket body. Such compressed fit will firmly hold the slidable locking member in its locked position.

In accordance with yet another aspect of the invention, the flat bracket body may be provided with cutout notches on either side thereof to facilitate assembly of the bracket body/locking member combination at the time of manufacture. Such cutout notches will be positioned sufficiently high on the bracket body so as not to interfere with the normal slidable movement and functioning of the locking member.

A principal object of the invention is to provide a lockable attachment bracket for connecting various articles to horizontal or vertical wire members of an existing wire grid.

A further object of the invention is to provide a lockable attachment bracket bearing a garment-hanging rod or rack for lockably yet releasably attaching such garment-hanging rod or rack to an existing wire grid.

An even further object of the invention is to provide a lockable attachment bracket which may be slidably yet lockably attached to two parallel horizontal wire members of the wire grid. By such arrangement, the bracket will remain slidable from side to side along the horizontal wire members while being securely locked in place so as not to be inadvertantly detached from such supporting wire members.

Further objects and advantages of the invention will become apparent to those skilled in the art upon reading of the following description of a preferred embodiment and consideration of the accompanying drawings.

DETAILED DESCRIPTION OF THE PREFERRED EMBODIMENTS

Figure 1:
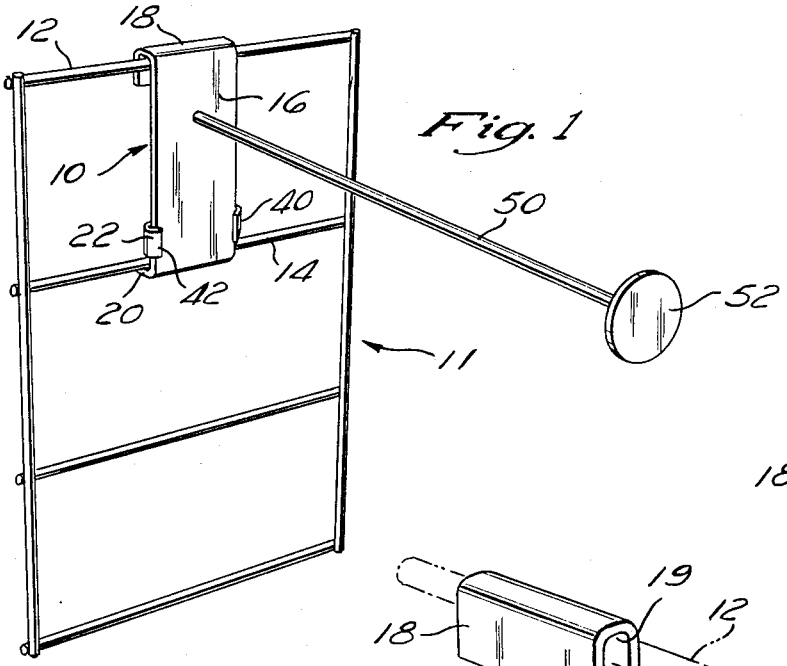
FIG. 1 is a perspective view of a garment hanging rod attached to a wire grid by way of a preferred lockable mounting bracket of the present invention.
Figure 4:
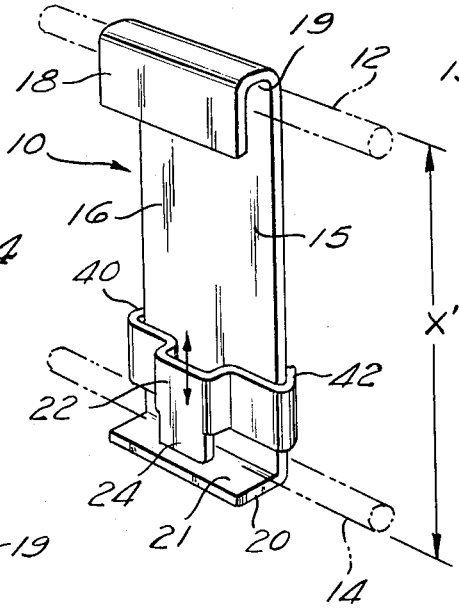
FIG. 4 is a perspective view of a preferred lockable mounting bracket of the present invention lockably disposed upon two parallel wire members.

Referring now to the drawings wherein showings are made for the purposes of describing the preferred embodiments of the invention and not for purposes of limiting its scope, FIGS. 1 and 4 show the lockable mounting bracket 10 of the present invention as it is lockably connected to adjacent horizontal wire members 12 and 14 of a wire grid. The bracket 10 comprises a generally flat bracket body 16 having a J-shaped curl portion 18 formed on the upper end thereof and a L-shaped perpendicular flange 20 extending from the lower end thereof. The J-shaped curl 18 is sized to fit over the upper wire member 12 in a hook-like fashion while the L-shaped flange 20 is sized to extend under the lower wire member 14 as shown.

Figure 3:
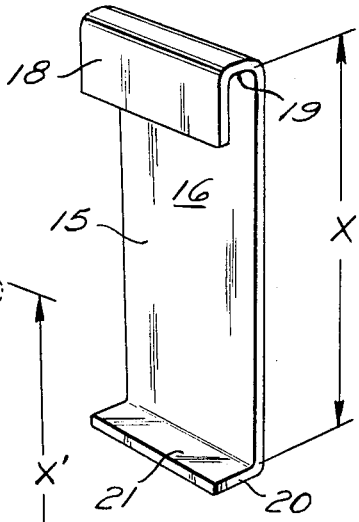
FIG. 3 is a perspective view of the generally flat bracket body of a preferred lockable mounting bracket of the present invention.

Referring now to FIGS. 3 and 4, the specific functional aspects of the lockable bracket may be appreciated. The body 16 of the bracket 10 is formed of a section of flat stock. The formation of the J-shaped curl 18 creates a transversely extending groove or channel 19, the inner confines of which are defined by the underside of the L-shaped curl. Such groove 19 is sized and configured to be slidably positionable over wire member 12.

The L-shaped flange 20 at the base of the bracket body 16 extends generally perpendicular to the body 16. A locking member 22 is slidably mounted upon the body member 16 and is provided with a keeper projection 24 adjacent its lower end. The keeper projection 24 is laterally spaced from the rear surface 15 of the body member 16 through a distance slightly greater than the diameter of the lower wire member 14.

The distance X from the top surface of the upper transverse hook-like groove 19 and the upper surface 21 of the perpendicular leg of the L-shaped flange 20 is equal to or slightly greater than the distance X' between the upper surface of the upper wire member 12 and the lower surface of the lower wire member 14. Such specific sizing of the lockable bracket member 10 permits the J-shaped curl 18 to be hooked over the top wire member 12 while the bracket body is subsequently pivoted downward to a point where the rear surface 15 of the mounting bracket 10 abuts the lower wire member 14. Additionally the L-shaped flange 20 extends beneath the lower wire member 14 so as to maintain the bracket in its operative position shown in FIGS. 1 and 4.

Figure 2:
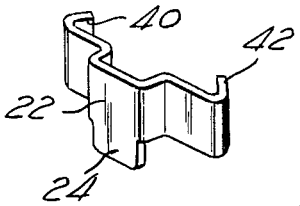
FIG. 2 is an enlarged perspective view of a locking member which forms a part of a preferred lockable mounting bracket of the present invention.

The manner in which the locking member 22 functions to lockably retain the bracket 10 upon the bar members 12 and 14 is best appreciated from FIGS. 2 and 4. The locking member 22 comprises a clip-like structure having crimped ends 40, 42 which wrap loosely around the transverse edges of the bracket body 16. Thus, as shown in FIG. 4, the locking member 22 is easily slidable over the center portion of the bracket body 16. When the bracket is positioned, as shown in FIG. 4, the force of gravity or sufficient manual pressure may be employed to pull the slidable locking member 22 downwardly such that the keeper projection 24 will abut against the upper surface 21 of L-shaped flange 20 and the keeper 24 will capture the lower wire member 14 between the flange 20 and rear surface 15 of the body 16. Accordingly, the keeper projection 24 will capture the lower wire member 14 firmly within the angular convergence formed between the upper surface 21 of the flange 20 and the rear surface 15 of the bracket body so as to prevent the bracket 10 from being pulled away from the lower wire member 14.

When it is desired to remove the lockable mounting bracket 10 from the wire grid 11, the locking member 22 may be grasped by hand and slidably pushed upwardly on the bracket body 16 so as to release the lower wire member 14 thereby permitting the lower end of the bracket 10 to be pulled away from the wire member 14. Thereafter, the J-shaped upper roll 18 of the bracket member 10 may be simply unhooked from the upper wire member 12, thereby fully releasing the bracket 10 from the wire grid 11.

The lockable bracket 10 of the present invention may be utilized to connect many different types of articles to many different types of wire grids. In one preferred embodiment shown in FIG. 1, the bracket is used to support a garment hanging rod 50 which extends outwardly from the body 16 of the bracket 10 and is firmly connected to the bracket body so as to extend opposite the J-shaped curl 18 and the L-shaped flange 20. The garment hanging rod 50 is provided with an end stop 52 which serves to prevent garments on hangers from sliding off the end of the rod 50.

So long as the lockable bracket 16 is lockingly disposed on the parallel wire members 12 and 14 of the wire grid 11, it will remain freely slidable from side to side thereon but may not be inadvertently knocked off the wire grid due to the locking feature of the bracket 10. Of course, the bracket 10 may be positioned on any two parallel horizontal wires of the grid, including the lower wires shown with respect to grid 11. Thus, the height of the garment hanging rod 50 may be adjusted by manually detaching the lockable bracket 10 and reconnecting it to higher or lower wire members on the wire grid 11 as desired.

Figure 5:
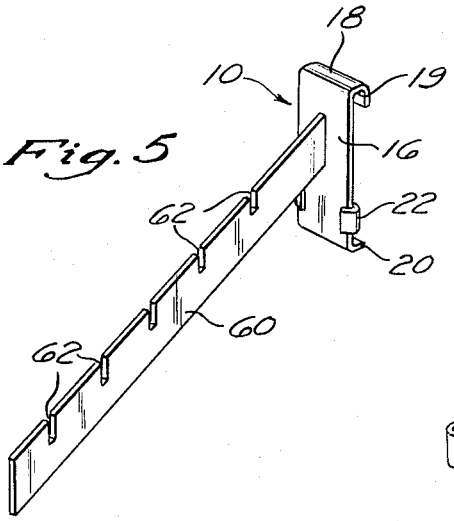
FIG. 5 is a slotted garment hanging rack incorporating a preferred lockable mounting bracket of the present invention.

An alternative garment hanging rod is shown in FIG. 5 wherein the lockable bracket 10 is provided with a slotted garment hanging rack 60 which extends outwardly from the side of the bracket body 16 opposite the J-shaped curl 18 and L-shaped flange 20. The slotted garment hanging rack 60 is provided with individual slots 62 to receive individual garment hangers.

Figure 6:
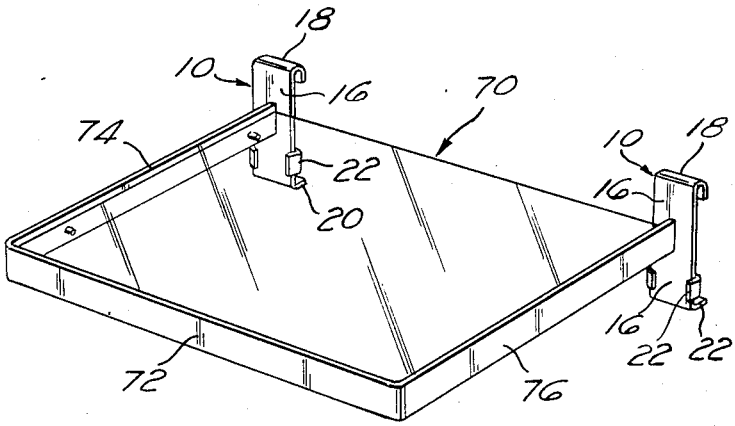
FIG. 6 is a merchandise shelf incorporating two preferred lockable mounting brackets of the present invention.

A still further alternative embodiment is the merchandise shelf 70 shown in FIG. 6. The shelf 70 comprises a flat horizontal surface contained within frame members 72, 74, and 76. Frame members 74 and 76 are attached to independently attached to separate lockable mounting brackets 10 of the present invention in a manner similar to that described with reference to the single-bracket embodiments shown in FIGS. 1 and 5. By such arrangement, the shelf may be periodically adjusted to different positions on a supporting wire grid but will be lockably held in each such position so as to prevent inadvertent bumping and release of the attachment brackets and resultant falling of the shelf and the merchandise contained thereon.

At the time of manufacture, the locking bracket shown in FIGS. 1–6 is formed by crimping or bending the lateral ends of the locking member 22 around the edges of the bracket body 10 as shown. However, an alternative notched bracket body, shown in FIG. 7, may be employed to minimize the degree of handling, and thus the expense of manufacturing the lockable mounting bracket of the present invention.

Figure 7:
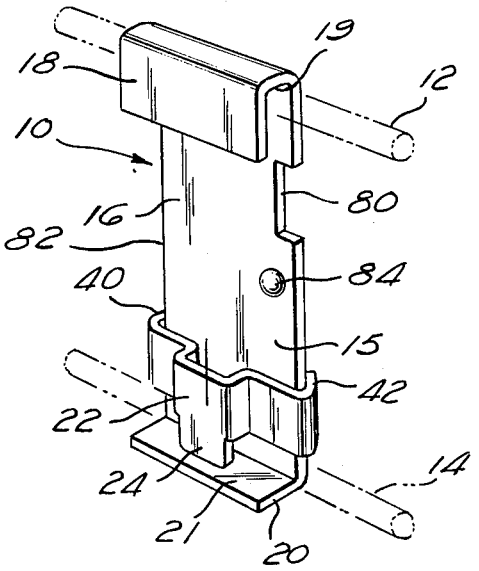
FIG. 7 is a perspective view of a modified preferred lockable mounting bracket of the present invention lockably disposed upon two parallel wire members.

As shown in FIG. 7, cutout notch 80 is formed on one side of the bracket body 16, near the top end thereof. Such cutout notch 80 is sized and configured to permit the crimped end 42 of the locking member 22 to pass easily therethrough. At the same time the opposite crimped end 40 of the locking member may be passed outside of the opposing lateral edge 82 of the bracket body. Thereafter, the locking member 22 may be slid downwardly on the bracket body 16 to its locking position at the bottom of the bracket as shown. With the locking member 22 so positioned at the bottom of the bracket, a metal punch is driven into the outer surface of the bracket body, just below the notch 80. Such will cause the formation of a raised protrusion 84 on the opposite (inner) surface of the bracket. This raised protrusion 84 will be sufficiently large to prevent the locking member 22 from sliding upwardly past such protrusion 84. Thus, once the locking member has been placed on the bracket body 16, the protrusion 84 will prevent the locking member 22 from being subsequently removed through notch 80. By such arrangement, the locking member 22 may be fully prefabricated/-preformed and subsequently positioned on the bracket body 16, rather than requiring the ends 40, 42 of the locking member to be forceably bent around the bracket body at the time of manufacture.

Of course, the variety of articles which may be connected to the lockable mounting bracket 10 of the present invention is virtually limitless. The garment hanging racks 50 and 60 and the merchandise shelf 70 shown in the preferred embodiments are mere examples of a few presently preferred uses that the lockable mounting bracket may enjoy. Various other applications, alterations, and modifications to the lockable mounting bracket of the present invention may be made and it is certainly intended to include all such applications, alterations, and modifications within the scope of the following claims and the equivalents thereof.

What is claimed is:

1. A mounting bracket for lockably attaching miscellaneous items to first and second wire members of a wire grid, said mounting bracket comprising:

a generally flat bracket body having lateral sides, a front surface, a rear surface, a J-shaped curl formed on a first longitudinal end thereof and a flange extending perpendicularly from a second longitudinal end thereof, said flange having an upper surface which is substantially continuous with and forms an approximate 90-degree angle with the rear surface of said mounting bracket body;

said J-shaped curl on the first longitudinal end of said bracket being sized and configured to be positionable over the first wire member in a hook-like fashion;

said flange located on the second end of the bracket being sized and configured to be positionable beneath said second wire member while the J-shaped curl of the first longitudinal end remains positioned over the first wire member; and a locking member connected to said bracket and reciprocably moveable between "locked" and "unlocked" positions, said locking member having a keeper projection extending downward therefrom such that when in said "locked" position the keeper projection will capture the second wire member within the approximate 90-degree angle formed between the upper surface of said flange and the rear surface of the mounting bracket, and when in its "unlocked" configuration the second wire member will be released therefrom such that said bracket may be freely moved away from said second wire member.

2. The mounting bracket of claim 1 wherein said locking member further comprises:

a rigid member having opposing first and second ends, said rigid member extending transversely across the rear surface of the mounting bracket body with the said opposing first and second ends thereof wrapped around the lateral edges of the bracket body so as to attach the rigid member to the bracket body while permitting the rigid member to remain longitudinally slidable thereupon between said "locked" configuration and said "unlocked" configuration.

3. The mounting bracket of claim 2 wherein said mounting bracket further comprises:

a cutaway notch on one lateral edge of the bracket and generally proximate the first longitudinal end thereof;

said cutaway notch being sized and configured to permit the first and second ends of the said rigid member to be preformed to wrap around the lateral edges of the bracket body such that one of said ends may be subsequently passed through said cutaway notch such that the rigid member may thereafter be longitudinally slidably descended upon said bracket body thereby effecting the attachment of the preformed rigid member to the bracket body while permitting the rigid member to remain longitudinally slidable along that portion of the bracket body which extends below the cutaway notch.

4. The mounting bracket of claim 3 further comprising a raised protrusion formed on a surface of said bracket to prevent said rigid member from being subsequently ascended along said bracket body so as to be removable through said cutaway notch.

5. A garment display rack comprising:

at least first and second generally parallel wire members attached to a supporting surface;

a connector bracket attachable to said generally parallel wire members, said connector bracket comprising:

a generally flat bracket body having a J-shaped curl formed on a first longitudinal end thereof and a flange extending perpendicularly from a second longitudinal end thereof, said flange having an upper surface which is substantially continuous with and forms an approximate 90-degree angle with the rear surface of said mounting bracket body;

said J-shaped curl on the first end of said bracket being sized and configured to be positionable over the first wire member, in a hook-like fashion;

said flange located on the second end of the bracket being sized and configured to be positionable beneath said second wire member while the J-shaped curl of the first longitudinal end is positioned over the first wire member; and a locking member connected to said bracket and reciprocably moveable between "locked" and "unlocked" positions, said locking member having a keeper projection extending downward therefrom such that when in said "locked" position the keeper projection will capture the second wire member within the approximate 90-degree angle formed between the upper surface of said flange and the rear surface of the mounting bracket, and when in its "unlocked" configuration the second wire member will be released therefrom such that said bracket may be freely moved away from said second wire member; and a garment display means connected to and extending from said connector bracket, said garment display means being configured to hold a plurality of garments on hangers.

6. The garment display rack of claim 5 wherein said garment display means is a rod having a proximal end and a distal end with the proximal end thereof connected to said connector bracket and the distal end thereof extending outwardly from the bracket body at an angle which will permit a plurality of garments on hangers to be suspended from said rod.

7. The garment display rack of claim 6 wherein said rod is further provided with a retainer means affixed at the distal end thereof, said retainer means being operative to deter garments on hangers from sliding over the distal end of said rod.

8. The garment display rack of claim 7 wherein said retainer means comprises a round disc attached to the distal end of said rod.

9. The garment display rack of claim 5 wherein said garment display means is a slotted garment hanging rack having proximal and distal ends with the proximal end thereof connected to said connector bracket and the distal end thereof extending outwardly from the bracket body at an angle which will permit a plurality of garments on hangers to be suspended from the slotted garment hanging rack.

10. A merchandise display shelf comprising:

at least first and second generally parallel wire members attached to a supporting surface; and at least two connector brackets attachable at separate points on said first and second wire members, each said connector bracket comprising:

a generally flat bracket body having a front surface, a rear surface, a J-shaped curl formed on a first longitudinal end thereof and a flange extending perpendicularly from a second longitudinal end thereof, said flange having an upper surface which is substantially continuous with and forms an approximate 90-degree angle with the rear surface of said mounting bracket body;

said J-shaped curl on the first end of said bracket being sized and configured to be positionable over the first wire member, in a hook-like fashion;

said flange located on the second end of the bracket being sized and configured to be positionable beneath said second wire member while the J-shaped curl of the first longitudinal end is positioned over the first wire member; and a locking member connected to said bracket and reciprocably moveable between "locked" and "unlocked" positions, said locking member having a keeper projection extending downward therefrom such that when in said "locked" position the keeper projection will capture the second wire member within the approximate 90-degree angle formed between the upper surface of said flange and the rear surface of the mounting bracket, and when in its "unlocked" configuration the second wire member will be released therefrom such that said bracket may be freely moved away from said second wire member.

* * * * *